US009743748B2

(12) United States Patent
Perera

(10) Patent No.: US 9,743,748 B2
(45) Date of Patent: Aug. 29, 2017

(54) TOOTHBRUSH HAVING INTEGRAL REPLACEABLE TOOTHPASTE CARTRIDGE

(71) Applicant: Anthony Perera, Cooper City, FL (US)

(72) Inventor: Anthony Perera, Cooper City, FL (US)

( * ) Notice: Subject to any disclaimer, the term of this patent is extended or adjusted under 35 U.S.C. 154(b) by 8 days.

(21) Appl. No.: 14/340,543

(22) Filed: Jul. 24, 2014

(65) Prior Publication Data

US 2015/0030373 A1 Jan. 29, 2015

Related U.S. Application Data

(60) Provisional application No. 61/858,110, filed on Jul. 24, 2013.

(51) Int. Cl.
*A47L 13/22* (2006.01)
*A46B 11/00* (2006.01)
*A46B 9/04* (2006.01)

(52) U.S. Cl.
CPC ..... *A46B 11/0027* (2013.01); *A46B 9/04* (2013.01); *A46B 11/0065* (2013.01)

(58) Field of Classification Search
CPC ..... B46K 11/0065; B46K 11/0027; B46K 11/0024; B46K 3/10
USPC ..... 401/277, 286
See application file for complete search history.

(56) References Cited

U.S. PATENT DOCUMENTS 3,256,894 A * 6/1966 Sherman ..... A46B 11/0055 222/209
4,049,354 A * 9/1977 O'Rourke ..... A46B 11/0041 401/134
4,277,194 A 7/1981 Smith
4,291,995 A 9/1981 Dikoff
5,908,257 A 6/1999 Martin
RE37,625 E * 4/2002 Wieder ..... A46B 5/02 15/143.1
6,648,641 B1 * 11/2003 Viltro ..... A61K 8/02 132/308
7,244,073 B2 * 7/2007 Trocino ..... A46B 11/0027 401/172
8,496,393 B2 * 7/2013 Martin ..... A46B 9/04 15/167.1
8,727,652 B2 * 5/2014 Jimenez ..... A46B 11/0024 401/172
2003/0215282 A1 * 11/2003 Edwards ..... A46B 11/0027 401/277
2004/0057773 A1 * 3/2004 Gray ..... A46B 11/0024 401/277
2007/0110503 A1 * 5/2007 Glover ..... A46B 11/0024 401/134

(Continued)

*Primary Examiner* — Jennifer C Chiang
(74) *Attorney, Agent, or Firm* — Allen F. Bennett; Bennett Intellectual Property

(57) ABSTRACT

A toothbrush has a head with bristles, a stem and a handle. A replaceable cartridge containing toothpaste is positioned within the handle. The cartridge includes a threaded rod and plunger. When a torque force is applied to the threaded rod the plunger may move longitudinally through the cartridge. This forces toothpaste from the cartridge and through a conduit in the handle to the head. He had includes one or more mechanisms for dispensing toothpaste on the bristles. The cartridge includes a nozzle having an integral one-way valve which extrudes the toothpaste. The head includes one or more nozzles which have an integral one-way valve which extrudes the toothpaste.

3 Claims, 3 Drawing Sheets

(56) References Cited

U.S. PATENT DOCUMENTS

| | | | | |
|---|---|---|---|---|
| 2012/0103355 | A1* | 5/2012 | Bowie | A46B 11/0027 132/200 |
| 2013/0020802 | A1 | 1/2013 | Ng | |

* cited by examiner

TOOTHBRUSH HAVING INTEGRAL REPLACEABLE TOOTHPASTE CARTRIDGE

CROSS-REFERENCE TO RELATED APPLICATIONS

This application claims priority to U.S. Provisional Application Ser. No. 61/858,110 filed on Jul. 24, 2014, the contents of which are hereby incorporated by reference in their entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

Field of Endeavor

The present invention relates to devices and methods for a toothbrush having an integral toothpaste cartridge. More particularly, the invention relates to a toothbrush having a replaceable toothpaste cartridge positioned within the handle.

Background Information

Dental hygiene is important an facet of good health. Especially with lengthening life spans, it has become more important than ever for persons to take good care of their teeth. Travel has also become a common and important part of life in the modern world. Economy of space is important in travel and in everyday life.

Brushing teeth requires 2 items: a toothbrush and toothpaste. It is not uncommon for a person traveling to forget to bring toothpaste or to inadvertently bring an almost empty tube of toothpaste with him or her on a trip. In addition, carrying both a toothbrush and toothpaste takes more room. It is also not unusual for a tube of toothpaste to create a mess if the cap not properly secured.

It is known in the art to provide a disposable toothbrush having a small amount of toothpaste inside the handle of the brush. Various mechanisms may be used to push toothpaste out of the head and into and on the bristles of the toothbrush. Unfortunately, existing designs are inefficient, designed for only a single use or only several uses or suffer from various mechanical disadvantages.

In view of the foregoing, there is a need for a sturdy, mechanically dependable toothbrush having an integral reservoir of toothpaste. It is therefore desirable to provide to provide a toothbrush capable of repeated use while also serving the functions of a tube of toothpaste.

BRIEF SUMMARY OF THE INVENTION

Accordingly, the primary object of the present invention is a toothbrush having an integral cartridge for holding and dispensing toothpaste.

In greater detail, a toothbrush is provided that has a head, a stem, a handle, a and a mechanism for actuating an interior cartridge. The stem includes a conduit extending from the handle to the head. The conduit is in fluid communication with one or more dispensing mechanisms located in the head. When the cartridge is actuated, toothpaste flows out of the cartridge, into the conduit and then to the head and onto the bristles. An opening in the handle provides access to an interior chamber housing the replaceable cartridge.

The toothpaste cartridge is locate within the handle. It includes a threaded longitudinal rod and a plunger engaged with the threaded longitudinal rod by means of an interior threaded bore. The threaded longitudinal rod applies a directional force upon the plunger when a torque force is transferred to it by means of a rotating knob or other device.

A toothbrush has a replaceable toothpaste cartridge and interchangeable brush heads comprising a shank having a head, a stem and a conduit running from a proximal end of the shank to the head, a handle having a base and a hollow interior chamber capable of retaining a replaceable toothpaste cartridge, the toothpaste cartridge having a nozzle having an integral one-way valve. The base of the handle engages the toothpaste cartridge such that when the base is twisted toothpaste extrudes out of the one-way valve of the nozzle.

In another embodiment, a toothbrush has a replaceable toothpaste cartridge and interchangeable brush heads wherein the toothpaste cartridge includes a threaded longitudinal rod and a plunger engaged with the threaded longitudinal rod by means of an interior threaded bore and wherein the threaded longitudinal rod applies a directional force upon the plunger when a torque force is transferred to it by means of a rotating knob or other device.

In another embodiment, a toothbrush has a replaceable toothpaste cartridge and interchangeable brush heads wherein the handle has an open bottom whereby the bottom is secured by a knob or rotary button adapted to the end of the handle by way of a closure or locking mechanism.

It is therefore an object of the present invention to provide a toothbrush having a replaceable cartridge within the handle which may be applied directly to the bristles from inside the toothbrush.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 2:
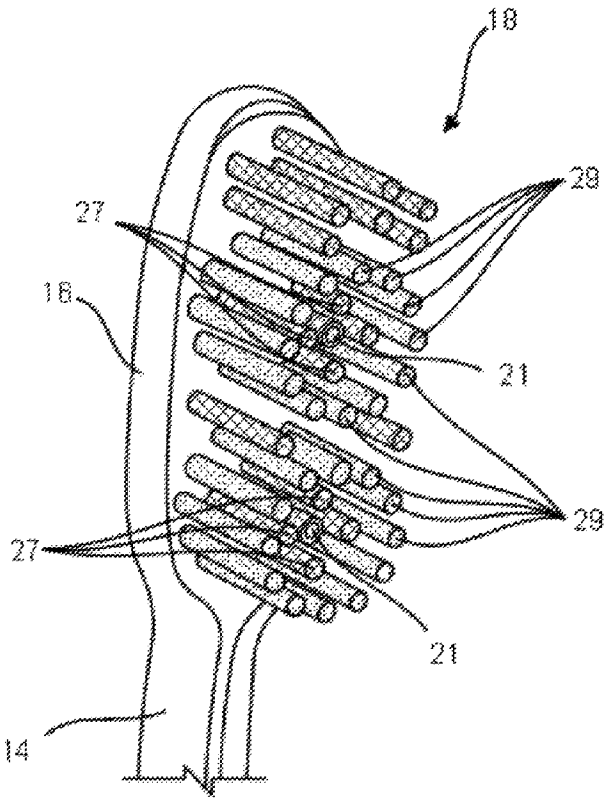
FIG. 2 is an enlarged perspective view of the toothbrush head of the toothbrush of FIG. 1 in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Disclosed is a toothbrush having an integral reservoir for retaining toothpaste. A replaceable cartridge may be disposed within the handle of the toothbrush. By twisting a knob at the base of the handle, a plunger within the cartridge may be actuated to force toothpaste through a nozzle at the top of the cartridge into a conduit through the stem of the toothbrush and through one or more nozzles within the head of the brush such that the toothpaste may be deposited on the bristles. The nozzle of the cartridge may include an integral one-way valve and the nozzles within the head of the brush may also comprise one way valves. The bristles may be organized into bundles of differing lengths, with inner bundles longer than the nozzles and the outer bristles longer than the inner bristles.

Figure 1:
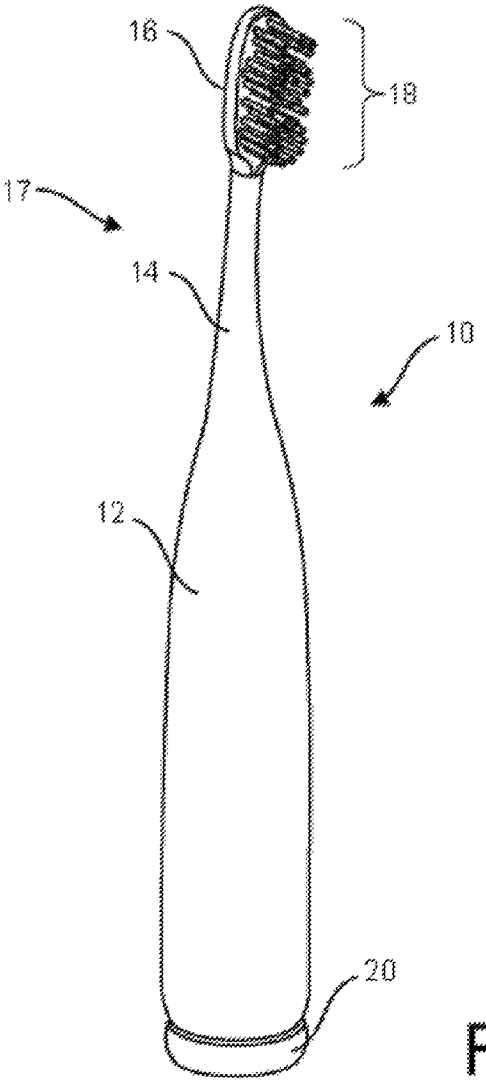
FIG. 1 is a perspective view of a toothbrush in accordance with the principles of the invention.

FIG. 1 shows a toothbrush in accordance with the principles of the invention. Toothbrush 10 may generally include two components, a handle 12 and a shank 17. The shank 17 may be comprised of a stem 14 and a head 16. The handle 12 may have a base 20.

FIG. 2 shows the head 16 in greater detail. The head 16 may include a plurality of bristles 18, which are organized into bundles 27 and 29. The head 16 also includes one or more nozzles 21. The bundles of bristles 18 may be arranged in a pattern relative to the positioning of the nozzles 21. In this embodiment, two nozzles 21 are arranged longitudinally along the head and are surrounded by two concentric circular rows of bundles of bristles 18. Each nozzle 21 is surrounded by a four inner bundles 27, and twelve outer bundles 29. Outer bundles 29 form a ring about the nozzle 21 concentric with the ring of inner bundles 27. Inner bundles 27 may be comprised of bristles having length equal to or greater than the length of nozzles 21. The outer bundles 29 may be comprised of bristles having a length greater than both the nozzles 21 and the inner bristles 27. It may be preferable to utilize a configuration having inner bristles protruding the same or greater distance from the head 16 as the nozzles but less than the distance by which the outer bristles 29 protrude.

It may be desirable to prevent the nozzles from impinging on the user's teeth while maximizing even distribution of toothpaste flowing outwardly from the nozzles 21. Having nozzles that do not protrude upward from the head 16 would prevent contact with teeth, but this may be undesirable because the toothpaste may collect about the head 16 and not reach and adequately coat the ends of the bristles 18. If the nozzles extend the same distance as the bristles 18, they may impinge upon the teeth causing discomfort or injury. The configuration of FIG. 2 may allow ample toothpaste to flow out the nozzles 21 and to the ends of the bristles 18 without contacting the teeth directly.

The handle 12 may include a base 20 that also functions as a knob. In this embodiment, the handle 12 and base 20 are smooth. The handle 12 and/or the base 20 may optionally include mechanisms for increasing the static friction and thus the grip for each of these components. These mechanisms may include a knurled surface, a rubber coating or the like.

Figure 3:
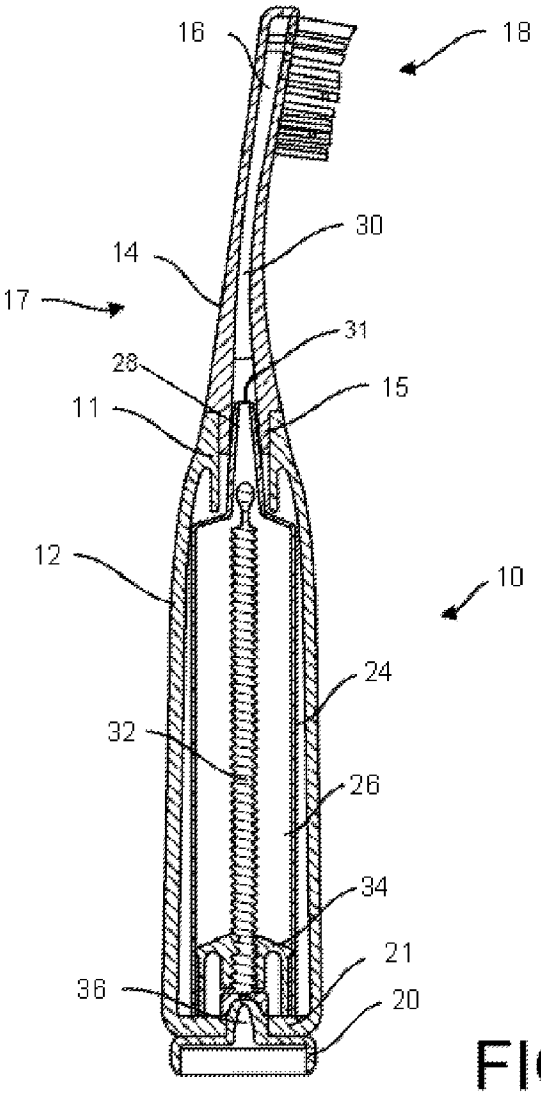
FIG. 3 is a cross-sectional view of a toothbrush and integral cartridge in accordance with the principles of the invention.

FIG. 3 shows a cross-sectional view of the toothbrush 10 in accordance with the principles of the invention. The base 20 may be removed to access an interior chamber of the handle. A toothpaste cartridge 24 may be placed within the interior chamber and may be sized to fit snugly within the interior chamber of the handle 12. The cartridge nozzle 28 at the top of the cartridge 24 may comprise a one-way valve 31 and may partially enter the conduit 30 in the stem 14 of the shank. The nozzle 28 may be conical and may impinge upon the entrance to the conduit 30 at the proximal end 15 of the shank 17 sufficiently to form a seal.

The cartridge 24 may include a threaded rod 32 extending the entire length of the cartridge 24. The threaded rod 32 may be engaged with a plunger 34, which has a threaded interior bore. The base of the threaded rod 32 includes a connection means 36, which may engage base 20, which may act as a knob. The connection means 36 may transmit torque force applied to the base 20. When torque is applied to base 20, the torque force may be transferred to the threaded rod 32 by means of the connection 36. As the threaded rod 32 rotates, the plunger 34 moves longitudinally along the length of the cartridge 24. As the plunger 34 traverses the length of the cartridge 24 it impinges upon the toothpaste 26 located within the cartridge 24. This impinging results in increased pressure upon the one-way valve 31 of the nozzle 28, and the toothpaste 26 may be extruded into the conduit 30. From there, the pressure applied to the toothpaste forces the toothpaste through conduit 30 and out of the nozzles 21 in the head 16 of the shank. From there, the toothpaste comes into contact with the inner bundles 27 and then the outer bundles 28.

When all of the toothpaste of a cartridge has been used, the cartridge may be removed from the bottom of the handle and replaced.

Proximal end 15 of the shank 17 removably engages distal end 11 of the handle 12 by means of threading, snapping together or other means commonly used for engaging and disengaging components. In this embodiment, the distal end 11 of the handle 12 comprises an annular cuff with an opening large enough for at least a portion of the nozzle 28 to protrude from. The proximal end 15 of the shank comprises a smaller cuff designed to fit between the distal end 11 and the nozzle 28. However, the shank 17 and its proximal end 15 do not restrain the cartridge. The cartridge 24 may only be removed from the bottom of the handle. The force exerted by the connection means between the handle 12 and the shank 17 are insufficient to hold the cartridge in place. The opening at the distal end of the handle 11 includes an opening only large enough for the nozzle 28 to protrude from, and is not wide enough for the entire cartridge to pass through. It may not be necessary for the handle 12 and shank 17 to form a tight seal. However, it may be desirable for the nozzle 28 to form a tight seal with the conduit 30.

Because the nozzle 28 of the cartridge includes an integral one-way valve 31, removing the shank 17 from the handle 12 will not result in exposure of unused toothpaste, thereby minimizing contamination, dessication or other effects to the unused toothpaste. Thus, if the shank is replaced with an altnernative shank, there is no cross-contamination. In this manner, more than one individual may use the same handle and same toothpaste by simply replacing the shank. This may reduce the spread of germs and illness. The nozzle of the cartridge may be rinsed when shanks are interchanged without diluting the toothpaste.

When all of the toothpaste 26 within a cartridge 24, has been extruded, the cartridge may be replaced. This allows an empty cartridge to be replaced with a new full one. The base 21 may be removed from the bottom of the handle 12 to provide access to the interior of the handle 12 such that the cartridge may be replaced. Optionally, the handle 12 may be opened along its side or by separation from the stem in order to facilitate replacement of an empty cartridge.

Figure 4:
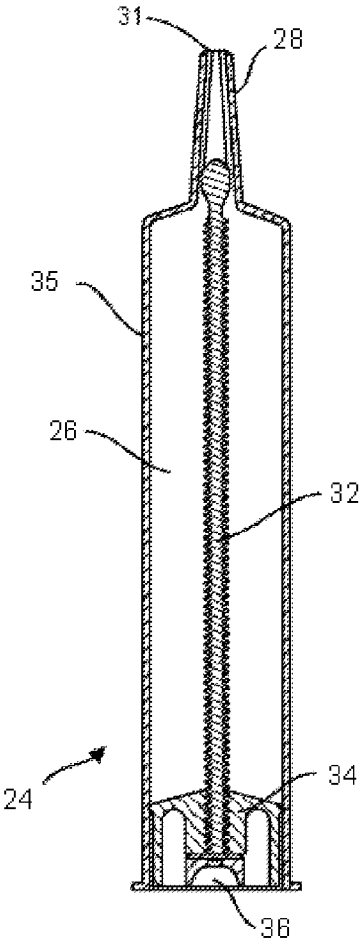
FIG. 4 is another view of a cartridge in accordance with the principles of the invention

FIG. 4 shows an enlarged cross-section of a cartridge 24. Plunger 34 may form a tight seal with the exterior wall 35 of the cartridge 24. This may prevent the toothpaste 26 from leaking out around the plunger 34.

Optionally nozzle 28 may be constructed wholly or partially from a somewhat pliable material such as rubber. This may facilitate a well sealed connection between the nozzle 28 and the conduit 30 within the stem 14.

In the embodiments of FIGS. 1-4, the plunger 34 within the cartridge 24 may be actuated by turning the knob 20. However, it may be desirable to actuate the plunger 34 by other mechanism. The head 16 may include any suitable mechanism for dispensing toothpaste onto the bristles 18. This may include a plurality of nozzles, one-way valves or any other suitable mechanism.

The handle 12 and stem 14 in this embodiment are substantially cylindrical. The stem 14 tilts slightly such that it forms a large obtuse angle with the handle 12. The angle formed between the stem 14 and the handle 12 may be varied according to a users desire. Typically, and may be preferable for the stem 14 and handle 12 to form an obtuse angle between 91 and 180°.

Figure 5:
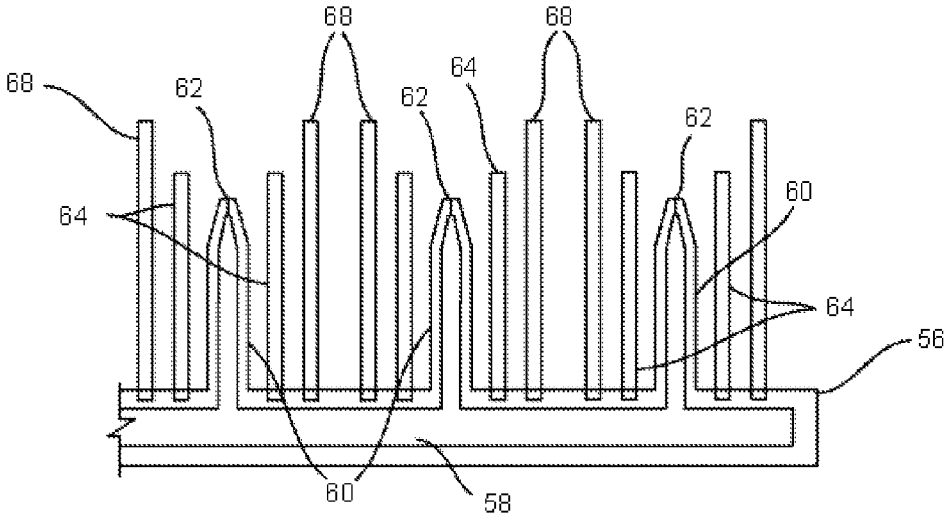
FIG. 5 is a cross-sectional view of a brush head of a toothbrush in accordance with the principles of the invention.

FIG. 5 shows a cross-section of a toothbrush head in accordance with the principles of the invention. A toothbrush head 56 receives toothpaste through conduit 58. Nozzles 60 extend upward from the head 56 and each have a one-way valve 62 through which toothpaste is extruded. In this embodiment, the one-way valves 62 comprise an elastomeric material molded to be at rest in a closed or "puckered" configuration, which seals the valve. When pressure is applied to the toothpaste in the conduit 58, the pressure causes the valve 62 to "unpucker" and open such that toothpaste extrudes from the nozzle 60 until there is no longer sufficient pressure on the toothpaste to open the valve 62. In this manner, toothpaste within the conduit does not dry and does not become contaminated. This may prevent clogging of the conduit and improve sanitation. This may also prevent water from entering the conduit when the brush head 56 is rinsed.

FIG. 5 also shows inner bundles 64 of bristles which are longer than the nozzles 60 and encircle the nozzle 60. Outer bundles 68 of bristles are arranged in a concentric circle around the inner bundles 62 and the nozzles 60. Outer bundles 68 may be comprised of bristles that are longer than both the inner bundle bristles and the nozzle 60.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A toothbrush having an integral reservoir comprising:
a shank, the shank comprising:
a stem having a proximal end and a distal end;
a head located at the distal end of the stem and having a plurality of bristles and at least one nozzle; and,
an open, continuous unobstructed conduit extending from an opening at the proximal end of the stem to the head and in fluid communication with the at least one nozzle; and
a handle having a distal end and a bottom, wherein the distal end is removably attachable to the proximal end of the stem;
a base removably attachable to the bottom of the handle, the base comprising a knob;
a replaceable cartridge having a conical nozzle containing toothpaste and disposed within the handle; and,
a plunger within the cartridge;
wherein the distal end of the handle has an opening large enough for the nozzle of the cartridge to pass through and impinge upon the opening to the conduit, but not wide enough for the cartridge to pass through;
wherein the nozzle partially enters the conduit, lies flush against the inside of the conduit, and impinges upon the opening to the conduit sufficient to form a seal thereby preventing toothpaste from leaking out from between the nozzle and the conduit;
wherein the plunger, upon being actuated by twisting the knob of the base, forces toothpaste through the conical nozzle on the cartridge, through the conduit in the stem and out of the at least one nozzle of the head;
wherein the plurality of bristles are organized into inner bundles and outer bundles which are arranged in concentric rings about the at least one nozzle; and,
wherein the inner bundles are comprised of bristles having lengths equal to a length of the at least one nozzle and the outer bundles are comprised of bristles having a length greater than the lengths of the bristles of the inner bundles.

2. The toothbrush of claim 1 wherein the at least one nozzle of the head comprises a one way valve.

3. The toothbrush of claim 2 wherein the one way valve comprises a tubular elastomeric material having a closed, puckered configuration when at rest and open, unpuckered configuration when toothpaste is forced through it.

* * * * *